US009758885B2

(12) United States Patent
Kienle et al.

(10) Patent No.: US 9,758,885 B2
(45) Date of Patent: Sep. 12, 2017

(54) COMPOSITION FOR METAL ELECTROPLATING COMPRISING LEVELING AGENT

(71) Applicant: BASF SE, Ludwigshafen (DE)

(72) Inventors: Marcel Patrik Kienle, Limburgerhof (DE); Dieter Mayer, Darmstadt (DE); Cornelia Roeger-Goepfert, Weinheim (DE); Alexandra Haag, Hemhofen (DE); Charlotte Emnet, Bad Duerkheim (DE); Alexander Fluegel, Bad Duerkheim (DE); Marco Arnold, Heidelberg (DE)

(73) Assignee: BASF SE, Ludwigshafen (DE)

( * ) Notice: Subject to any disclaimer, the term of this patent is extended or adjusted under 35 U.S.C. 154(b) by 0 days.

(21) Appl. No.: 14/438,688

(22) PCT Filed: Oct. 30, 2013

(86) PCT No.: PCT/IB2013/059777
§ 371 (c)(1),
(2) Date: Apr. 27, 2015

(87) PCT Pub. No.: WO2014/072885
PCT Pub. Date: May 15, 2014

(65) Prior Publication Data

US 2015/0284865 A1 Oct. 8, 2015

Related U.S. Application Data

(60) Provisional application No. 61/724,350, filed on Nov. 9, 2012.

(51) Int. Cl.
*C25D 3/56* (2006.01)
*C25D 3/58* (2006.01)
(Continued)

(52) U.S. Cl.
CPC ..... *C25D 3/38* (2013.01); *C23C 18/38* (2013.01); *C25D 3/32* (2013.01)

(58) Field of Classification Search
CPC ..... C25D 3/38; C25D 3/32
(Continued)

(56) References Cited

U.S. PATENT DOCUMENTS 3,820,999 A 6/1974 Nobuo Tsuji et al.
4,769,301 A * 9/1988 Butcher ..... C08G 69/00 430/1
(Continued)

FOREIGN PATENT DOCUMENTS

EP 2 530 102 A1 12/2012
JP 2007-107074 * 4/2007 ..... C25D 3/38
(Continued)

OTHER PUBLICATIONS

International Search Report and Written Opinion issued Apr. 18, 2014 in PCT/IB2013/059777 filed Oct. 30, 2013.
U.S. Appl. No. 14/438,688, filed Apr. 27, 2015, Kienle, et al.

*Primary Examiner* — Edna Wong
(74) *Attorney, Agent, or Firm* — Oblon, McClelland, Maier & Neustadt, L.L.P.

(57) ABSTRACT

A composition comprising a source of metal ions and at least one additive comprising at least one polyaminoamide, said polyaminoamide comprising the structural unit represented by formula I (Continued)

(I)

or derivatives of the polyaminoamide of formula I obtainable by complete or partial protonation, N-functionalization or N-quaternization with a non-aromatic reactant, wherein $D^6$ is, for each repeating unit 1 to s independently, a divalent group selected from a saturated or unsaturated $C_1$-$C_{20}$ organic radical, $D^7$ is, for each repeating unit 1 to s independently, a divalent group selected from straight chain or branched $C_2$-$C_{20}$ alkanediyl, which may optionally be interrupted by heteroatoms or divalent groups selected from O, S and $NR^{10}$, $R^1$ is, for each repeating unit 1 to s independently, selected from H, $C_1$-$C_{20}$ alkyl, and $C_1$-$C_{20}$ alkenyl, which may optionally be substituted by hydroxyl, alkoxy or alkoxycarbonyl, or, together with $R^2$, may form a divalent group $D^8$, and $R^2$ is, for each repeating unit 1 to s independently, selected from H, $C_1$-$C_{20}$ alkyl, and $C_1$-$C_{20}$ alkenyl, which may optionally be substituted by hydroxyl, alkoxy or alkoxycarbonyl, or, together with $R^1$, may form a divalent group $D^8$, and $D^8$ is selected from straight chain or branched $C_1$-$C_{18}$ alkanediyl, which may optionally be interrupted by heteroatoms or divalent groups selected from O, S and $NR^{10}$, s is an integer from 1 to 250, $R^{10}$ is selected from H, $C_1$-$C_{20}$ alkyl, and $C_1$-$C_{20}$ alkenyl, which may optionally be substituted by hydroxyl, alkoxy or alkoxycarbonyl.

16 Claims, 4 Drawing Sheets

(51) Int. Cl.

| | |
|---|---|
| ***C25D 3/00*** | (2006.01) |
| ***C25D 3/38*** | (2006.01) |
| ***C25D 3/32*** | (2006.01) |
| ***C23C 18/38*** | (2006.01) |

(58) Field of Classification Search
USPC ..... 205/238, 239, 261, 296
See application file for complete search history.

(56) References Cited

U.S. PATENT DOCUMENTS

| | | | | |
|---|---|---|---|---|
| 6,425,996 | B1 | 7/2002 | Dahms et al. | |
| 2004/0234493 | A1* | 11/2004 | Witteler ..... | A61K 8/84 424/78.17 |
| 2012/0292193 | A1 | 11/2012 | Roeger-Goepfert et al. | |
| 2014/0097092 | A1 | 4/2014 | Roeger-Goepfert et al. | |

FOREIGN PATENT DOCUMENTS

| | | | |
|---|---|---|---|
| WO | WO 03/014192 | A1 | 2/2003 |
| WO | WO 2010/115717 | A1 | 10/2010 |
| WO | WO 2010/115756 | A1 | 10/2010 |
| WO | WO 2010/115757 | A1 | 10/2010 |
| WO | WO 2010/115796 | A1 | 10/2010 |
| WO | WO 2011/012462 | A2 | 2/2011 |
| WO | WO 2011/064154 | A2 | 6/2011 |

* cited by examiner

COMPOSITION FOR METAL ELECTROPLATING COMPRISING LEVELING AGENT

The invention relates to a composition for metal electroplating for void free bottom-up filling of features on electronic substrates, in particular those having nanometer dimensions and high aspect ratios.

BACKGROUND OF THE INVENTION

Filling of small features, such as vias and trenches, by copper electroplating is an essential part of the semiconductor manufacture process. It is well known, that the presence of organic substances as additives in the electroplating bath can be crucial in achieving a uniform metal deposit on a substrate surface and in avoiding defects, such as voids and seams, within the copper lines.

One class of additives are the so-called levelers. Levelers are used to provide a substantially planar surface over the filled features. In literature, a variety of different leveling compounds has been described. In most cases, leveling compounds are N-containing and optionally substituted and/or quaternized polymers.

U.S. Pat. No. 6,425,996 B1 discloses leveling agents comprising the reaction product of polyaminoamides and epihalohydrins, dihalohydrins and 1-halogen-2,3-propanediols, respectively.

EP 1978134 A1 discloses leveling agents comprising polyethoxylated polyamides or polyethoxylated polyaminoamides. In the examples the end groups are both polyalkoxylated with 25, 40 or 20 alkoxy repeating units.

WO 2011/064154 discloses leveling agents of the following formula

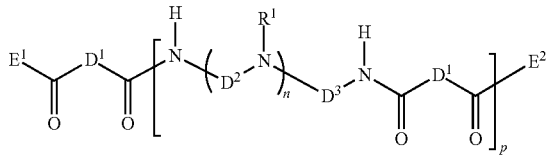

Unpublished international patent application No. PCT/IB2012/052727 discloses a composition comprising a polyaminoamide comprising an aromatic moiety being attached to or located within the polymeric backbone.

It is an object of the present invention to provide a copper electroplating additive having good leveling properties, in particular leveling agents capable of providing a substantially planar metal layer and filling features on the nanometer and on the micrometer scale without substantially forming defects, such as but not limited to voids, with a metal electroplating bath, in particular a copper electroplating bath.

It is a further object of the present invention to provide a copper electroplating bath cabable of depositing a low impurity metal layer.

SUMMARY OF THE INVENTION

It has been found, that particular polyaminoamides and derivatives thereof as defined herein may be used as additives, in particular leveling agents, in metal, particularly in copper electroplating baths showing an improved performance.

Therefore the present invention provides a composition comprising a source of metal ions and at least one additive comprising at least one polyaminoamide, said polyaminoamide comprising the structural unit represented by formula I (I)

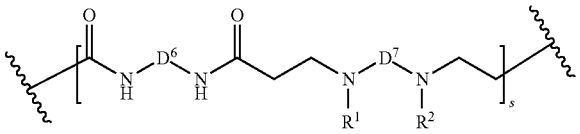

or derivatives of the polyaminoamide of formula I obtainable by complete or partial protonation, N-functionalization or N-quaternization with a non-aromatic reactant, wherein $D^6$ is, for each repeating unit 1 to s independently, a divalent group selected from a saturated or unsaturated $C_1$-$C_{20}$ organic radical, $D^7$ is selected from straight chain or branched $C_2$-$C_{20}$ alkanediyl, which may optionally be interrupted by heteroatoms or divalent groups selected from O, S and $NR^{10}$, $R^1$ is, for each repeating unit 1 to s independently, selected from H, $C_1$-$C_{20}$ alkyl, and $C_1$-$C_{20}$ alkenyl, which may optionally be substituted by hydroxyl, alkoxy or alkoxycarbonyl, or, together with $R^2$, forms a divalent group $D^8$, an $R^2$ is, for each repeating unit 1 to s independently, selected from H, $C_1$-$C_{20}$ alkyl, and $C_1$-$C_{20}$ alkenyl, which may optionally be substituted by hydroxyl, alkoxy or alkoxycarbonyl, or, together with $R^1$, forms a divalent group $D^8$, and $D^8$ is selected from straight chain or branched $C_1$-$C_{18}$ alkanediyl, which may optionally be interrupted by heteroatoms or divalent groups selected from O, S and $NR^{10}$, and s is an integer from 1 to 250, and $R^{10}$ is selected from H, $C_1$-$C_{20}$ alkyl, and $C_1$-$C_{20}$ alkenyl, which may optionally be substituted by hydroxyl, alkoxy or alkoxycarbonyl.

Another embodiment of the present invention is the use of polyaminoamides as described herein in a bath for depositing metal containing layers.

Yet another embodiment of the present invention is a process for depositing a metal layer on a substrate by contacting a plating solution as described herein with the substrate, and applying a current to the substrate to deposit a metal layer onto the substrate. The process is particularly useful for depositing metal, particularly copper layers on substrate comprising micrometer and/or nanometer-sized features.

It has been found that the use of compositions according to the present invention for electroplating provides deposited metal layers, particularly copper layers, having reduced overplating, particularly reduced mounding. The metal layers provided by the present invention are substantially planar, even on substrates exhibiting apertures of a very wide range of different aperture sizes (scale: below or equal 130 nanometers to 2 micrometers). Furthermore it has been found that the present invention provides metal layers substantially without the formation of added defects, such as voids, in the features.

The agents/additives according to the present invention can further advantageously be used for electroplating of copper in through silicon vias (TSV). Such vias normally have diameters of several micrometers up to 100 micrometers and large aspect ratios of at least 4, sometimes above 10.

Furthermore the agents/additives according to the present invention can advantageously be used in bonding technologies such as the manufacture of copper pillars of typically 50 to 100 micrometers height and diameter for the bumping process, in circuit board technologies like the manufacture of high-density-interconnects on printed circuit boards using microvia plating or plated-through-hole technologies, or in other packaging processes for electronic circuits.

A further significant advantage of this leveling effect is that less material has to be removed in post-deposition operations. For example, chemical mechanical polishing (CMP) is used to reveal the underlying features. The more level deposit of the invention corresponds to a reduction in the amount of metal which must be deposited, therefore resulting in less removal later by CMP. There is a reduction in the amount of scrapped metal and, more significantly, a reduction in the time required for the CMP operation. The material removal operation is also less severe which, coupled with the reduced duration, corresponds to a reduction in the tendency of the material removal operation to impart defects.

DETAILED DESCRIPTION OF THE INVENTION

It is essential for the present invention that the polyaminoamide additives according to formula I do not comprise aromatic moieties. As used herein, "aromatic" means any compound comprising unsaturated organic molecules having conjugated pi electrons and which fulfills the 4n+2 Hückel rule of aromaticity.

As used herein, "feature" refers to the geometries on a substrate, such as, but not limited to, trenches and vias. "Apertures" refer to recessed features, such as vias and trenches. As used herein, the term "plating" refers to metal electroplating, unless the context clearly indicates otherwise. "Deposition" and "plating" are used interchangeably throughout this specification.

The term "alkyl" means $C_1$ to $C_{20}$ alkyl and includes linear, branched and cyclic alkyl. "Substituted alkyl" means that one or more of the hydrogens on the alkyl group is replaced with another substituent group, such as, but not limited to, cyano, hydroxy, halo, $(C_1\text{-}C_6)$alkoxy, $(C_1\text{-}C_6)$ alkylthio, thiol, nitro, and the like.

As used herein, "alkanediyl" refers to a diradical of linear or branched, straight chain or cyclic alkanes.

As used herein, "accelerator" refers to an organic additive that increases the plating rate of the electroplating bath. The terms "accelerator" and "accelerating agent" are used interchangeably throughout this specification. In literature, sometimes the accelerator component is also named "brightener", "brightening agent", or "depolarizer".

As used herein, "leveler" and "polyaminoamide" are used synonymously since the additive decreases the plating rate of the electroplating bath. In the prior art many of the inhibitors are also called "levelers" or "leveling agents" since in nanometer-sized features most of these compounds show a so called leveling effect. A further class of inhibitors are the so called "suppressors" or "suppressing agents", sometimes also called "wetting agents" or "surfactants". Levelers are sometimes also referred to as polarizers or inhibitors.

As used herein, "plating selectivity" means after plating, the copper deposition height ratio on the feature bottom compared to copper growth on wafer surface close to the feature. "Overplating" refers to a thicker metal deposit over the feature as compared to areas free of features. Insofar the additives according to the present inventions act as "leveler". "Dense feature areas" means an area exhibiting smaller distances between neighboring features compared to a comparative area containing apertures with a relatively large distance in between. Smaller distances means distances below 2 micrometer, and preferably below 1 micrometer, and even more preferably below 500 nm. Such difference in the plating thickness over dense feature areas as compared to the plating thickness over areas free of features or containing relatively few features is referred to as "step height" or "mounding". As used herein, "deposition rate" means the height of the copper deposit formed in the feature bottom per minute. "Aspect ratio" means the ratio of the depth of the feature to the opening diameter or width of the feature.

The at least one polyaminoamide comprises the structural unit represented by formula I (I)

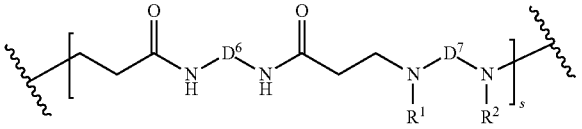

wherein $D^6$ is, for each repeating unit 1 to s independently, a divalent group selected from a saturated or unsaturated $C_1\text{-}C_{20}$ organic radical, $D^7$ is, for each repeating unit 1 to s independently, a divalent group selected from straight chain or branched $C_2\text{-}C_{20}$ alkanediyl, which may optionally be interrupted by heteroatoms or divalent groups selected from O, S and $NR^{10}$, $R^1$ is, for each repeating unit 1 to s independently, selected from H, $C_1\text{-}C_{20}$ alkyl, and $C_1\text{-}C_{20}$ alkenyl, which may optionally be substituted by hydroxyl, alkoxy or alkoxycarbonyl, or, together with $R^2$, forms a divalent group $D^8$, $R^2$ is, for each repeating unit 1 to s independently, selected from H, $C_1\text{-}C_{20}$ alkyl, and $C_1\text{-}C_{20}$ alkenyl, which may optionally be substituted by hydroxyl, alkoxy or alkoxycarbonyl, or, together with $R^1$, forms a divalent group $D^8$, $D^8$ is selected from straight chain or branched $C_1\text{-}C_{18}$ alkanediyl, which may optionally be interrupted by heteroatoms or divalent groups selected from O, S and $NR^{10}$, s is an integer from 1 to 250, and $R^{10}$ is selected from H, $C_1\text{-}C_{20}$ alkyl, and $C_1\text{-}C_{20}$ alkenyl, which may optionally be substituted by hydroxyl, alkoxy or alkoxycarbonyl.

Also useful are derivatives of the polyaminoamide of formula I obtainable by complete or partial protonation, N-functionalization or N-quaternization with a non-aromatic reactant.

Preferably, $D^6$ is, for each repeating unit 1 to s independently, selected from straight chain or branched, acyclic or cyclic $C_1\text{-}C_{20}$ alkanediyl. More preferably $D^6$ is an acyclic $C_1\text{-}C_{20}$ alkanediyl. Even more preferably $D^6$ is a $C_1$ to $C_{10}$ alkandiyl. Even more preferably $D^6$ is selected from $(CH_2)_g$, wherein g is an integer from 1 to 6, more preferably 1 to 3, most preferably 1.

In a preferred embodiment $D^7$ is, for each repeating unit 1 to s independently, selected from $C_2$- to $C_{10}$-alkanediyl.

In a particularly preferred embodiment $D^7$ is selected from $C_2$- to $C_{10}$-alkanediyl, even more preferably straight chain $C_2$- to $C_6$-alkanediyl, even more preferably from $C_2$-$C_3$ alkanediyl, most preferably ethanediyl.

In another preferred embodiment $D^7$ is, for each repeating unit 1 to s independently, selected from Formula II (II)

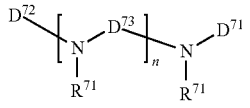

wherein $D^{71}$, $D^{72}$, $D^{73}$ are divalent groups independently selected from $C_1$ to $C_6$ alkanediyl, preferably $C_2$ to $C_4$ alkanediyl, most preferably from ethanediyl, $R^{71}$ is a monovalent group selected from H or $C_1$ to $C_6$ alkyl or at least two groups $R^{71}$ together form a divalent group $D^{73}$, n is an integer from 0 to 5, preferably 0 to 3, most preferably 1.

In another preferred embodiment $D^7$ is, for each repeating unit 1 to s independently, selected from Formula III (III)

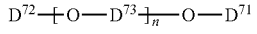

wherein $D^{71}$, $D^{72}$, $D^{73}$ and n have the prescribed meanings.

In another preferred embodiment, $R^1$ and $R^2$ may together form a divalent group $D^7$ as defined above. A cyclic group comprising at least two amine groups as shown in formula 1a is formed in this way.

(Ia)

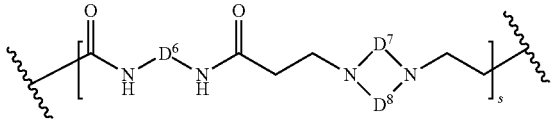

$D^7$ and $D^8$ in the cyclic diamine may be identical or different. Preferably $D^7$ and $D^8$ are identical. More preferably $D^8$ is selected from a $C_1$ to $C_6$ alkanediyl, particularly $C_1$ to $C_3$ alkanediyl.

Preferably, s is an integer of 2 or more, more preferably 4 or more, most preferably 10 or more.

In a particular embodiment s is an integer of from 1 to 150, even more preferably of from 2 to 150, even more preferably of from 2 to 100, even more preferably of from 2 to 50, most preferably of from 4 to 50.

Particularly preferred polyaminoamides are those according to formula IV (IV)

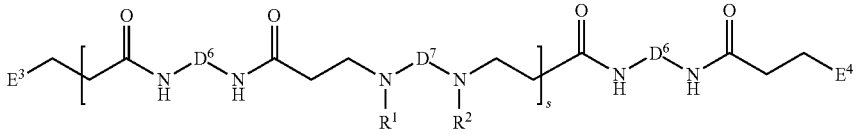

Preferably, $R^1$ is, for each repeating unit 1 to s independently, selected from H, $C_1$-$C_{20}$-alkyl, or $C_1$-$C_{20}$-alkenyl, which may optionally be substituted by hydroxyl, alkoxy or alkoxycarbonyl. In a first preferred embodiment the polyaminoamide is unsubstituted and therefore $R^1$ is hydrogen. In a second preferred embodiment the polyaminoamide is N-substituted and $R^1$ is, for each repeating unit 1 to s independently, selected from $C_1$-$C_{10}$-alkyl or $C_1$-$C_{10}$-alkenyl which may optionally be substituted by hydroxyl, alkoxy or alkoxycarbonyl. More preferably $R^1$ is selected from $C_1$-$C_3$ alkyl.

Preferably, $R^2$ is, for each repeating unit 1 to s independently, selected from H, $C_1$-$C_{20}$-alkyl, or $C_1$-$C_{20}$-alkenyl, which may optionally be substituted by hydroxyl, alkoxy or alkoxycarbonyl. In a first preferred embodiment the polyaminoamide is unsubstituted and therefore $R^2$ is hydrogen. In a second preferred embodiment the polyaminoamide is N-substituted and $R^2$ is, for each repeating unit 1 to s independently, selected from $C_1$-$C_{10}$-alkyl or $C_1$-$C_{10}$-alkenyl which may optionally be substituted by hydroxy, alkoxy or alkoxycarbonyl. More preferably $R^2$ is selected from $C_1$-$C_3$ alkyl. $R^1$ and $R^2$ may be the same or different. Preferably $R^1$ and $R^2$ are the same.

wherein $D^6$, $D^7$, $R^1$, $R^2$ and s have the prescribed meanings and $E^3$ and $E^4$ are independently selected from (a) NH—$C_1$-$C_{20}$-alkyl or NH—$C_1$-$C_{20}$-alkenyl, (b) N—($C_1$-$C_{20}$-alkyl)$_2$ or N—($C_1$-$C_{20}$-alkenyl)$_2$ or N—($C_1$-$C_{20}$-alkyl)($C_1$-$C_{20}$-alkenyl)

(c) $NR^2$-$D^7$-$NR^2H$, or (d) $NR^2$-$D^7$-$NR^2$—$CH_2$—$CH_2$—CO—NH—($C_1$-$C_{20}$-alkyl) or $NR^2$-$D^7$-$NR^2$—$CH_2$—$CH_2$—CO—NH—($C_1$-$C_{20}$-alkenyl).

Preferably, $E^3$ and $E^4$ are independently selected from $NR^1$-$D^7$-$NR^2H$.

In a preferred embodiment the polyaminoamides I, Ia or IV are obtainable by reacting at least one diamine with at least one N,N'-bisacrylamide.

Preferably the at least one diamine comprises two secondary amino groups or one secondary and one primary amino group. In one embodiment, the at least one diamine may be an acyclic diamine, such as but are not limited to acyclic $C_2$ to $C_{10}$ alkylamines. In another embodiment, the at least one diamine may be a cyclic alkyldiamine, such as but are not limited to $C_2$ to $C_{20}$ cycloalkylamines.

In particular, the at least one diamine is selected from the group of N,N'-dimethyl-1,2-diaminoethane, N,N'-dimethyl- 1,3-diaminopropane, N,N'-dimethyl-1,4-diaminobutane, N—N'-diethyl-1,2-diaminoethane, N,N'-diethyl-1,3-diaminopropane, N,N'-diethyl-1,4-diaminobutane, piperazine, N,N'-Bis(aminoalkyl)piperazine, 2-(methylamino)ethylamine, 3-(methylamino)propylamine, 2-aminoethylpiperazine, N-(2-aminoethyl)ethanolamine, ethylene diamine, hexamethylene diamine, etheramines of formula IIIa

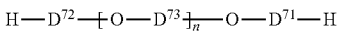

(IIIa)

such as but not limited to $H_2N—(CH_2)_2—O—(CH_2)_2—NH_2$ or $H_2N—(CH_2)_2—O—(CH_2)_2—O—(CH_2)_2—NH_2$ or polyamines of formula IIa

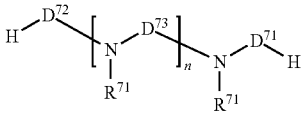

(IIa)

Particularly preferred are ethylene diamines are hexamethylene diamine, piperazine, N,N'-bis(aminoalkyl)piperazine, N,N'-bis-(3-aminopropyl)methylamine, and combinations thereof.

Particularly preferred combinations of diamines are piperazine and hexamethylenediamine, piperazine and N,N-bis-(3-aminopropyl)methylamine, piperazine and N,N'-bisaminopropyl piperazine, and piperazine and ethylene diamine.

Preferably, the at least one bisacrylamide is selected from the group of N,N'-methylenebisacrylamide, N,N'-ethylenebisacrylamide, 1,6-hexamethylenebisacrylamide, N,N'-octamethylenebisacrylamide, and mixtures thereof.

In a fourth preferred embodiment the polyaminoamides of formulae I, Ia or IV are N-functionalized.

N-Functionalized polyaminoamides I, Ia or IV can be synthesized from polyaminoamides I, Ia or IV, respectively, in a further reaction step. An additional functionalization can serve to modify the properties of the polyaminoamides I, Ia or IV. To this end, the primary, secondary and tertiary amino groups present in the polyaminoamides I, Ia or IV are converted by means of suitable agents which are capable of reaction with amino groups. This forms functionalized polyaminoamides I, Ia or IV.

The primary, secondary and tertiary amino groups present in the polyaminoamide can be protonated or alkylated and/or quaternized by means of suitable protonating or alkylating agents. Protonation may simply take place if the additive is used in an acidic solution. Examples for suitable alkylating agents are organic compounds which contain active halogen atoms, such as alkyl, alkenyl and alkynyl halides, and the like. Additionally, compounds such as alkyl sulphate, alkyl sultone, epoxide, alkyl sulphite, dialkyl carbonate, methyl formiate and the like may also be used. Examples of corresponding alkylating agents comprise ethylene oxide, propylene oxide, butylene oxide, propane sultone, dimethyl sulphate, dimethyl sulphite, dimethyl carbonate, (3-chloro-2-hydroxypropyl)trimethylammonium chloride, or the like.

Functionalized polyaminoamides I, Ia or IV can also be synthesized from polyaminoamides I, Ia or IV in two or more further reaction steps by applying a sequence of different protonating or alkylating agents. For example, the primary, secondary and tertiary amino groups present in the polyaminoamides I, Ia or IV are first reacted with an epoxide and in a second reaction step reacted with dimethyl sulphate.

Besides the synthesis routes described above the polyaminoamides according to the present invention may also prepared by any other known methods, e.g. by the methods described in WO 03/014192.

Due to its strong leveling performance the additives according to the present inventions are also referred to as leveling agent or leveler. Although the additive according to the present invention has strong leveling properties in electroplating of submicrometer-sized features, the use and performance of the additives according to the present invention is not limited to its leveling properties and may advantageously be used in other metal plating applications, e.g. for depositing through silicon vias (TSV), for other purposes.

The present invention provides a plated metal layer, particularly a plated copper layer, on a substrate containing features on the nanometer and/or micrometer scale wherein the metal layer has reduced overplating and all features are substantially free of added voids, and preferably substantially free of voids.

Suitable substrates are any used in the manufacture of electronic devices, such as integrated circuits. Such substrates typically contain a number of features, particularly apertures, having a variety of sizes. Particularly suitable substrates are those having apertures on the nanometer and on the micrometer scale.

It will be appreciated by those skilled in the art that more than one leveling agent may be used. When two or more leveling agents are used, at least one of the leveling agents is a polyaminoamide or a derivative thereof as described herein. It is preferred to use only one polyaminoamide leveling agent in the plating composition.

Suitable additional leveling agents include, but are not limited to, one or more of polyalkanolamine and derivatives thereof, polyethylene imine and derivatives thereof, quaternized polyethylene imine, polyglycine, poly(allylamine), polyaniline, polyurea, polyacrylamide, poly(melamine-co-formaldehyde), reaction products of amines with epichlorohydrin, reaction products of an amine, epichlorohydrin, and polyalkylene oxide, reaction products of an amine with a polyepoxide, polyvinylpyridine, polyvinylimidazole, polyvinylpyrrolidone, or copolymers thereof, nigrosines, pentamethyl-para-rosaniline hydrohalide, hexamethyl-pararosaniline hydrohalide, or compounds containing a functional group of the formula N—R—S, where R is a substituted alkyl, unsubstituted alkyl, substituted aryl or unsubstituted aryl. Typically, the alkyl groups are $(C_1-C_6)$alkyl and preferably $(C_1-C_4)$alkyl. In general, the aryl groups include $(C_6-C_{20})$aryl, preferably $(C_6-C_{10})$aryl. Such aryl groups may further include heteroatoms, such as sulfur, nitrogen and oxygen. It is preferred that the aryl group is phenyl or napthyl. The compounds containing a functional group of the formula N—R—S are generally known, are generally commercially available and may be used without further purification.

In such compounds containing the N—R—S functional group, the sulfur ("S") and/or the nitrogen ("N") may be attached to such compounds with single or double bonds. When the sulfur is attached to such compounds with a single bond, the sulfur will have another substituent group, such as but not limited to hydrogen, $(C_1-C_{12})$alkyl, $(C_2-C_{12})$alkenyl, $(C_6-C_{20})$aryl, $(C_1-C_{12})$alkylthio, $(C_2-C_{12})$alkenylthio, $(C_6-C_{20})$arylthio and the like. Likewise, the nitrogen will have one or more substituent groups, such as but not limited to hydrogen, $(C_1-C_{12})$alkyl, $(C_2-C_{12})$alkenyl, $(C_7-C_{10})$aryl, and the like. The N—R—S functional group may be acyclic or cyclic. Compounds containing cyclic N—R—S functional groups include those having either the nitrogen or the sulfur or both the nitrogen and the sulfur within the ring system.

In general, the total amount of leveling agents in the electroplating bath is from 0.5 ppm to 10000 ppm based on the total weight of the plating bath. The leveling agents according to the present invention are typically used in a total amount of from about 0.1 ppm to about 1000 ppm based on the total weight of the plating bath and more typically from 1 to 100 ppm, although greater or lesser amounts may be used.

The electroplating baths according to the present invention may include one or more optional additives. Such optional additives include, but are not limited to, accelerators, suppressors, surfactants and the like. Such suppressors and accelerators are generally known in the art. It will be clear to one skilled in the art which suppressors and/or accelerators to use and in what amounts.

A large variety of additives may typically be used in the bath to provide desired surface finishes for the Cu plated metal. Usually more than one additive is used with each additive forming a desired function. Advantageously, the electroplating baths may contain one or more of accelerators, suppressors, sources of halide ions, grain refiners and mixtures thereof. Most preferably the electroplating bath contains both, an accelerator and a suppressor in addition to the leveling agent according to the present invention. Other additives may also be suitably used in the present electroplating baths.

Any accelerators may be advantageously used in the compositions according to the present invention. Accelerators useful in the present invention include, but are not limited to, compounds comprising one or more sulphur atom and a sulfonic/phosphonic acid or their salts.

The generally preferred accelerators have the general structure $M_AO_3X_A—R_{A1}—(S)_a—R^{A2}$, with:

$M^A$ is a hydrogen or an alkali metal (preferably Na or K)

$X^A$ is P or S a=1 to 6

$R^{A1}$ is selected from C1-C8 alkyl group or heteroalkyl group, an aryl group or a heteroaromatic group. Heteroalkyl groups will have one or more heteroatom (N, S, O) and 1-12 carbons. Carbocyclic aryl groups are typical aryl groups, such as phenyl, napthyl. Heteroaromatic groups are also suitable aryl groups and contain one or more N, O or S atom and 1-3 separate or fused rings.

$R^{A2}$ is selected from H or (—S—$R^{A1'}XO_3M$), with $R^{A1'}$ being identical or different from $R^{A1}$.

More specifically, useful accelerators include those of the following formulae:

$$X^AO_3S—R^{A1}—SH$$

$$X^AO_3S—R^{A1}—S—R^{A1'}—SO_3X^A$$

$$X^AO_3S—Ar—S—Ar—SO_3X^A$$

with $R^{A1}$ as defined above and Ar is Aryl.

Particularly preferred accelerating agents are:

SPS: bis-(3-sulfopropyl)-disulfide disodium salt

MPS: 3-mercapto-1-propansulfonic acid, sodium salt

Other examples of accelerators, used alone or in mixture, include, but are not limited to: MES (2-Mercaptoethanesulfonic acid, sodium salt); DPS (N,N-dimethyldithiocarbamic acid (3-sulfopropylester), sodium salt); UPS (3-[(aminoiminomethyl)-thio]-1-propylsulfonic acid); ZPS (3-(2-benzthiazolylthio)-1-propanesulfonic acid, sodium salt); 3-mercapto-propylsulfonicacid-(3-sulfopropyl)ester; methyl-(ω-sulphopropyl)-disulfide, disodium salt; methyl-(ω-sulphopropyl)-trisulfide, disodium salt.

Such accelerators are typically used in an amount of about 0.1 ppm to about 3000 ppm, based on the total weight of the plating bath. Particularly suitable amounts of accelerator useful in the present invention are 1 to 500 ppm, and more particularly 2 to 100 ppm.

Any suppressor may be advantageously used in the compositions according to the present invention. Suppressors useful in the present invention include, but are not limited to, polymeric materials, particularly those having heteroatom substitution, and more particularly oxygen substitution. It is preferred that the suppressor is a polyalkyleneoxide. Suitable suppressors include polyethylene glycol copolymers, particularly polyethylene glycol polypropylene glycol copolymers. The arrangement of ethylene oxide and propylene oxide of suitable suppressors may be block, gradient, or random. The polyalkylene glycol may comprise further alkylene oxide building blocks such as butylene oxide. Preferably, the average molecular weight of suitable suppressors exceeds about 2000 g/mol. The starting molecules of suitable polyalkylene glycol may be alkyl alcohols such as methanol, ethanol, propanol, n-butanol and the like, aryl alcohols such as phenols and bisphenols, alkaryl alcohols such as benzyl alcohol, polyol starters such as glycol, glycerin, trimethylol propane, pentaerythritol, sorbitol, carbohydrates such as saccharose, and the like, amines and oligoamines such as alkyl amines, aryl amines such as aniline, triethanol amine, ethylene diamine, and the like, amides, lactams, heterocyclic amines such as imidazol and carboxylic acids. Optionally, polyalkylene glycol suppressors may be functionalized by ionic groups such as sulfate, sulfonate, ammonium, and the like.

Particularly useful suppressing agents in combination with the levelers according to the present inventions are:

(a) Suppressing agents obtainable by reacting an amine compound comprising at least three active amino functional groups with a mixture of ethylene oxide and at least one compound selected from $C_3$ and $C_4$ alkylene oxides as described in WO 2010/115796.

Preferably the amine compound is selected from diethylene triamine, 3-(2-aminoethyl)aminopropylamine, 3,3'-iminodi(propylamine), N,N-bis(3-aminopropyl)methylamine, bis(3-dimethylaminopropyl)amine, triethylenetetraamine and N,N'-bis(3-aminopropyl)ethylenediamine.

(b) Suppressing agents obtainable by reacting an amine compound comprising active amino functional groups with a mixture of ethylene oxide and at least one compound selected from $C_3$ and $C_4$ alkylene oxides, said suppressing agent having a molecular weight $M_w$ of 6000 g/mol or more, forming an ethylene $C_3$ and/or $C_4$ alkylene random copolymer as described in WO 2010/115756.

(c) Suppressing agent obtainable by reacting an amine compound comprising at least three active amino functional groups with ethylene oxide and at least one compound selected from $C_3$ and $C_4$ alkylene oxides from a mixture or in sequence, said suppressing agent having a molecular weight $M_w$ of 6000 g/mol or more as described in WO 2010/115757.

Preferably the amine compound is selected from ethylene diamine, 1,3-diaminopropane, 1,4-diaminobutane, 1,5-diaminopentane, 1,6-diaminohexane, neopentanediamine, isophoronediamine, 4,9-dioxadecane-1,12-diamine, 4,7,10-trioxyatridecane-1,13-diamine, triethylene glycol diamine, diethylene triamine, (3-(2-aminoethyl)aminopropylamine, 3,3'-iminodi(propylamine), N,N-bis(3-aminopropyl)methylamine, bis(3-dimethylaminopropyl)amine, triethylenetetraamine and N,N''-bis(3-aminopropyl)ethylenediamine.

(d) Suppressing agent selected from compounds of formula S1

(S1)

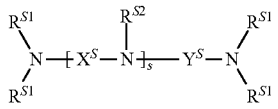

wherein the $R^{S1}$ radicals are each independently selected from a copolymer of ethylene oxide and at least one further $C_3$ to $C_4$ alkylene oxide, said copolymer being a random copolymer, the $R^{S2}$ radicals are each independently selected from $R^{S1}$ or alkyl, $X^S$ and $Y^S$ are spacer groups independently, and $X^s$ for each repeating unit independently, selected from $C_2$ to $C_6$ alkandiyl and $Z^S$—(O—$Z^S$)$_t$ wherein the $Z^S$ radicals are each independently selected from $C_2$ to $C_6$ alkandiyl, s is an integer equal to or greater than 0, and t is an integer equal to or greater than 1, as described in WO 2010/115717.

Preferably spacer groups $X^S$ and $Y^S$ are independently, and $X^s$ for each repeating unit independently, selected from $C_2$ to $C_4$ alkylene. Most preferably $X^S$ and $Y^S$ are independently, and $X^S$ for each repeating unit independently, selected from ethylene (—$C_2H_4$—) or propylene (—$C_3H_6$—).

Preferably $Z^S$ is selected from $C_2$ to $C_4$ alkylene, most preferably from ethylene or propylene.

Preferably s is an integer from 1 to 10, more preferably from 1 to 5, most preferably from 1 to 3. Preferably t is an integer from 1 to 10, more preferably from 1 to 5, most preferably from 1 to 3.

In another preferred embodiment the $C_3$ to $C_4$ alkylene oxide is selected from propylene oxide (PO). In this case EO/PO copolymer side chains are generated starting from the active amino functional groups The content of ethylene oxide in the copolymer of ethylene oxide and the further $C_3$ to $C_4$ alkylene oxide can generally be from about 5% by weight to about 95% by weight, preferably from about 30% by weight to about 70% by weight, particularly preferably between about 35% by weight to about 65% by weight.

The compounds of formula (S1) are prepared by reacting an amine compound with one ore more alkylene oxides. Preferably the amine compound is selected from ethylene diamine, 1,3-diaminopropane, 1,4-diaminobutane, 1,5-diaminopentane, 1,6-diaminohexane, neopentanediamine, isophoronediamine, 4,9-dioxadecane-1,12-diamine, 4,7,10-trioxatridecane-1,13-diamine, triethylene glycol diamine, diethylene triamine, (3-(2-aminoethyl)amino)propylamine, 3,3'-iminodi(propylamine), N,N-bis(3-aminopropyl)methylamine, bis(3-dimethylaminopropyl)amine, triethylenetetraamine and N,N'-bis(3-aminopropyl)ethylenediamine.

The molecular weight $M_w$ of the suppressing agent of formula S1 may be between about 500 g/mol to about 30000 g/mol. Preferably the molecular weight $M_w$ should be about 6000 g/mol or more, preferably from about 6000 g/mol to about 20000 g/mol, more preferably from about 7000 g/mol to about 19000 g/mol, and most preferably from about 9000 g/mol to about 18000 g/mol. Preferred total amounts of alkylene oxide units in the suppressing agent may be from about 120 to about 360, preferably from about 140 to about 340, most preferably from about 180 to about 300.

Typical total amounts of alkylene oxide units in the suppressing agent may be about 110 ethylene oxide units (EO) and 10 propylene oxide units (PO), about 100 EO and 20 PO, about 90 EO and 30 PO, about 80 EO and 40 PO, about 70 EO and 50 PO, about 60 EO and 60 PO, about 50 EO and 70 PO, about 40 EO and 80 PO, about 30 EO and 90 PO, about 100 EO and 10 butylene oxide (BuO) units, about 90 EO and 20 BO, about 80 EO and 30 BO, about 70 EO and 40 BO, about 60 EO and 50 BO or about 40 EO and 60 BO to about 330 EO and 30 PO units, about 300 EO and 60 PO, about 270 EO and 90 PO, about 240 EO and 120 PO, about 210 EO and 150 PO, about 180 EO and 180 PO, about 150 EO and 210 PO, about 120 EO and 240 PO, about 90 EO and 270 PO, about 300 EO and 30 butylene oxide (BuO) units, about 270 EO and 60 BO, about 240 EO and 90 BO, about 210 EO and 120 BO, about 180 EO and 150 BO, or about 120 EO and 180 BO.

(e) Suppressing agent obtainable by reacting a polyhydric alcohol condensate compound derived from at least one polyalcohol of formula (S2) $X^S(OH)_u$ by condensation with at least one alkylene oxide to form a polyhydric alcohol condensate comprising polyoxyalkylene side chains, wherein u is an integer from 3 to 6 and $X^S$ is an u-valent linear or branched aliphatic or cycloaliphatic radical having from 3 to 10 carbon atoms, which may be substituted or unsubstituted, as described in WO 2011/012462.

Preferred polyalcohol condensates are selected from compounds of formulae (S2a)

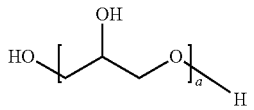

(S2b)

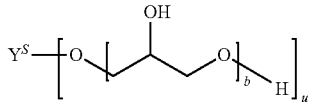

(S2c)

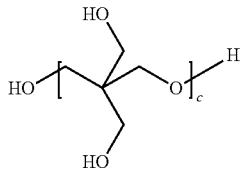

wherein $Y^S$ is an u-valent linear or branched aliphatic or cycloaliphatic radical having from 1 to 10 carbon atoms, which may be substituted or unsubstituted, a is an integer from 2 to 50, b may be the same or different for each polymer arm u and is an integer from 1 to 30, c is an integer from 2 to 3, and n is an integer from 1 to 6. Most preferred Polyalcohols are glycerol condensates and/or pentaerythritol condensates.

(f) Suppressing agent obtainable by reacting a polyhydric alcohol comprising at least 5 hydroxyl functional groups with at least one alkylene oxide to form a polyhydric alcohol comprising polyoxyalkylene side chains as described in WO 2011/012475. Preferred polyalcohols are linear or cyclic monosaccharide alcohols represented by formula (S3a) or (S3b)

$$HOCH_2—(CHOH)_v—CH_2OH \quad (S3a)$$

$$(CHOH)_w \quad (S3b)$$

wherein v is an integer from 3 to 8 and w is an integer form 5 to 10. Most preferred monosaccharide alcohols are sorbitol, mannitol, xylitol, ribitol and inositol. Further preferred polyalcohols are monosaccharides of formula (S4a) or (S4b)

$$CHO—(CHOH)_x—CH_2OH \quad (S4a)$$

$$CH_2OH—(CHOH_y—CO—(CHOH)_z—CH_2OH \quad (S4b)$$

wherein x is an integer of 4 to 5, and y, z are integers and y+z is 3 or 4. Most preferred monosaccharide alcohols are selected from the aldoses allose, altrose, galactose, glucose, gulose, idose, mannose, talose, glucoheptose, mannoheptose or the ketoses fructose, psicose, sorbose, tagatose, mannoheptulose, sedoheptulose, taloheptulose, alloheptulose.

These are particularly effective, strong suppressing agents that cope with the seed overhang issue and provide substantially defect free trench filling despite a non-conformal copper seed.

When suppressors are used, they are typically present in an amount in the range of from about 1 to about 10,000 ppm based on the weight of the bath, and preferably from about 5 to about 10,000 ppm.

The metal ion source may be any compound capable of releasing metal ions to be deposited in the electroplating bath in sufficient amount, i.e. is at least partially soluble in the electroplating bath. It is preferred that the metal ion source is soluble in the plating bath. Suitable metal ion sources are metal salts and include, but are not limited to, metal sulfates, metal halides, metal acetates, metal nitrates, metal fluoroborates, metal alkylsulfonates, metal arylsulfonates, metal sulfamates, metal gluconates and the like. It is preferred that the metal is copper. It is further preferred that the source of metal ions is copper sulfate, copper chloride, copper acetate, copper citrate, copper nitrate, copper fluoroborate, copper methane sulfonate, copper phenyl sulfonate and copper p-toluene sulfonate. Copper sulfate pentahydrate and copper methane sulfonate are particularly preferred. Such metal salts are generally commercially available and may be used without further purification.

Besides metal electroplating the compositions may be used in electroless deposition of metal containing layers. The compositions may particularly used in the deposition of barrier layers containing Ni, Co, Mo, W and/or Re. In this case, besides metal ions, further elements of groups III and V, particularly B and P may be present in the composition for electroless deposition und thus co-deposited with the metals.

The metal ion source may be used in the present invention in any amount that provides sufficient metal ions for electroplating on a substrate. Suitable metal ion metal sources include, but are not limited to, tin salts, copper salts, and the like. When the metal is copper, the copper salt is typically present in an amount in the range of from about 1 to about 300 g/l of plating solution. It will be appreciated mixtures of metal salts may be electroplated according to the present invention. Thus, alloys, such as copper-tin having up to about 2 percent by weight tin, may be advantageously plated according to the present invention. The amounts of each of the metal salts in such mixtures depend upon the particular alloy to be plated and are well known to those skilled in the art.

In general, besides the metal ion source and at least one of the leveling agents (S2) to (S4), further referred to as polyalkanolamines, the present metal electroplating compositions preferably include electrolyte, i.e. acidic or alkaline electrolyte, one or more sources of metal ions, optionally halide ions, and optionally other additives like accelerators and/or suppressors. Such baths are typically aqueous. The water may be present in a wide range of amounts. Any type of water may be used, such as distilled, deionized or tap.

The electroplating baths of the present invention may be prepared by combining the components in any order. It is preferred that the inorganic components such as metal salts, water, electrolyte and optional halide ion source, are first added to the bath vessel followed by the organic components such as leveling agents, accelerators, suppressors, surfactants and the like.

Typically, the plating baths of the present invention may be used at any temperature from 10 to 65 degrees C. or higher. It is preferred that the temperature of the plating baths is from 10 to 35 degrees C. and more preferably from 15 degrees to 30 degrees C.

Suitable electrolytes include such as, but not limited to, sulfuric acid, acetic acid, fluoroboric acid, alkylsulfonic acids such as methanesulfonic acid, ethanesulfonic acid, propanesulfonic acid and trifluoromethane sulfonic acid, arylsulfonic acids such as phenyl sulfonic acid and toluenesulfonic acid, sulfamic acid, hydrochloric acid, phosphoric acid, tetraalkylammonium hydroxide, preferably tetramethylammonium hydroxide, sodium hydroxide, potassium hydroxide and the like. Acids are typically present in an amount in the range of from about 1 to about 300 g/L, alkaline electrolytes are typically present in an amount of about 0.1 to about 20 g/L or to yield a pH of 8 to 13 respectively, and more typically to yield a pH of 9 to 12.

Such electrolytes may optionally contain a source of halide ions, such as chloride ions as in copper chloride or hydrochloric acid. A wide range of halide ion concentrations may be used in the present invention such as from about 0 to about 500 ppm. Typically, the halide ion concentration is in the range of from about 10 to about 100 ppm based on the plating bath. It is preferred that the electrolyte is sulfuric acid or methanesulfonic acid, and preferably a mixture of sulfuric acid or methanesulfonic acid and a source of chloride ions. The acids and sources of halide ions useful in the present invention are generally commercially available and may be used without further purification.

The general process of copper electrodeposition on semiconductor integrated circuit substrates is described with respect to FIGS. 1 and 2 without restricting the invention thereto.

FIG. 1*a* shows a dielectric substrate 1 seeded with a copper layer 2a. With reference to FIG. 1*b* a copper layer 2' is deposited onto the dielectric substrate 1 by electrodeposition. The trenches 2c of the substrate 1 are filled and an overplating of copper 2b, also referred to as "overburden", is generated on top of the whole structured substrate. During the process, after optional annealing, the overburden of copper 2b is removed by chemical mechanical planarization (CMP), as depicted in FIG. 1*c*.

The effect of a leveling agent is generally described with respect to FIGS. 2*a* and 2*b*. Without a leveling agent the deposition leads to a high ratio a/b much greater then 1, the so called mounding. In contrast, the aim is to reduce the ratio a/b to a value, which is as close as possible to 1.

A particular advantage of the present invention is that overplating, particularly mounding, is reduced or substantially eliminated. Such reduced overplating means less time and effort is spent in removing metal, such as copper, during subsequent chemical-mechanical planarization (CMP) processes, particularly in semiconductor manufacture. A further advantage of the present invention is that a wide range of aperture sizes may be filled within a single substrate resulting in a substantially even surface having a ratio a/b of 1.5 or less, preferably 1.2 or less, most preferably 1.1 or less. Thus, the present invention is particularly suitable to evenly filling apertures in a substrate having a variety of aperture sizes, such as from 0.01 micrometer to 100 micrometer or even larger.

A further significant advantage of this leveling effect is that less material has to be removed in post-deposition operations. For example, chemical mechanical planarization (CMP) is used to reveal the underlying features. The more level deposit of the invention corresponds to a reduction in the amount of metal which must be deposited, therefore resulting in less removal later by CMP. There is a reduction in the amount of scrapped metal and, more significantly, a reduction in the time required for the CMP operation. The material removal operation is also less severe which, coupled with the reduced duration, corresponds to a reduction in the tendency of the material removal operation to impart defects.

Metal, particularly copper, is deposited in apertures according to the present invention without substantially forming voids within the metal deposit. By the term "without substantially forming voids", it is meant that 95% of the plated apertures are void-free. It is preferred that the plated apertures are void-free.

Typically, substrates are electroplated by contacting the substrate with the plating baths of the present invention. The substrate typically functions as the cathode. The plating bath contains an anode, which may be soluble or insoluble. Optionally, cathode and anode may be separated by a membrane. Potential is typically applied to the cathode. Sufficient current density is applied and plating performed for a period of time sufficient to deposit a metal layer, such as a copper layer, having a desired thickness on the substrate. Suitable current densities, include, but are not limited to, the range of 1 to 250 $mA/cm^2$. Typically, the current density is in the range of 1 to 60 $mA/cm^2$ when used to deposit copper in the manufacture of integrated circuits. The specific current density depends upon the substrate to be plated, the leveling agent selected and the like. Such current density choice is within the abilities of those skilled in the art. The applied current may be a direct current (DC), a pulse current (PC), a pulse reverse current (PRC) or other suitable current.

In general, when the present invention is used to deposit metal on a substrate such as a wafer used in the manufacture of an integrated circuit, the plating baths are agitated during use. Any suitable agitation method may be used with the present invention and such methods are well-known in the art. Suitable agitation methods include, but are not limited to, inert gas or air sparging, work piece agitation, impingement and the like. Such methods are known to those skilled in the art. When the present invention is used to plate an integrated circuit substrate, such as a wafer, the wafer may be rotated such as from 1 to 150 RPM and the plating solution contacts the rotating wafer, such as by pumping or spraying. In the alternative, the wafer need not be rotated where the flow of the plating bath is sufficient to provide the desired metal deposit.

Metal, particularly copper, is deposited in apertures according to the present invention without substantially forming voids within the metal deposit. By the term "without substantially forming voids", it is meant that 95% of the plated apertures are void-free. It is preferred that the plated apertures are void-free.

While the process of the present invention has been generally described with reference to semiconductor manufacture, it will be appreciated that the present invention may be useful in any electrolytic process where an essentially level or planar copper deposit having high reflectivity is desired, and where reduced overplating and metal filled small features that are substantially free of voids are desired. Such processes include printed wiring board manufacture. For example, the present plating baths may be useful for the plating of vias, pads or traces on a printed wiring board, as well as for bump plating on wafers. Other suitable processes include packaging and interconnect manufacture. Accordingly, suitable substrates include lead frames, interconnects, printed wiring boards, and the like.

Plating equipment for plating semiconductor substrates are well known. Plating equipment comprises an electroplating tank which holds Cu electrolyte and which is made of a suitable material such as plastic or other material inert to the electrolytic plating solution. The tank may be cylindrical, especially for wafer plating. A cathode is horizontally disposed at the upper part of tank and may be any type substrate such as a silicon wafer having openings such as trenches and vias. The wafer substrate is typically coated with a seed layer of Cu or other metal to initiate plating thereon. A Cu seed layer may be applied by chemical vapor deposition (CVD), physical vapor deposition (PVD), or the like. An anode is also preferably circular for wafer plating and is horizontally disposed at the lower part of tank forming a space between the anode and cathode. The anode is typically a soluble anode.

These bath additives are useful in combination with membrane technology being developed by various tool manufacturers. In this system, the anode may be isolated from the organic bath additives by a membrane. The purpose of the separation of the anode and the organic bath additives is to minimize the oxidation of the organic bath additives.

The cathode substrate and anode are electrically connected by wiring and, respectively, to a rectifier (power supply). The cathode substrate for direct or pulse current has a net negative charge so that Cu ions in the solution are reduced at the cathode substrate forming plated Cu metal on the cathode surface. An oxidation reaction takes place at the anode. The cathode and anode may be horizontally or vertically disposed in the tank.

The present invention is useful for depositing a metal layer, particularly a copper layer, on a variety of substrates, particularly those having variously sized apertures. For example, the present invention is particularly suitable for depositing copper on integrated circuit substrates, such as semiconductor devices, with small diameter vias, trenches or other apertures. In one embodiment, semiconductor devices are plated according to the present invention. Such semiconductor devices include, but are not limited to, wafers used in the manufacture of integrated circuits.

While the process of the present invention has been generally described with reference to semiconductor manufacture, it will be appreciated that the present invention may be useful in any electrolytic process where an essentially level or planar copper deposit having high reflectivity is desired. Accordingly, suitable substrates include lead frames, interconnects, printed wiring boards, and the like.

All percent, ppm or comparable values refer to the weight with respect to the total weight of the respective composition except where otherwise indicated. All cited documents are incorporated herein by reference.

BRIEF DESCRIPTION OF THE FIGURES

FIG. 1*a* schematically shows a dielectric substrate 1 seeded with a copper layer 2a.

Figure 1A:
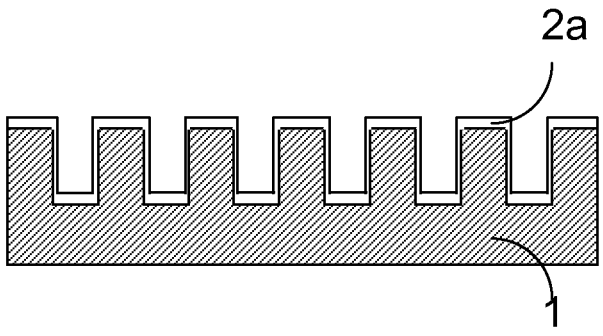
Figure 1B:
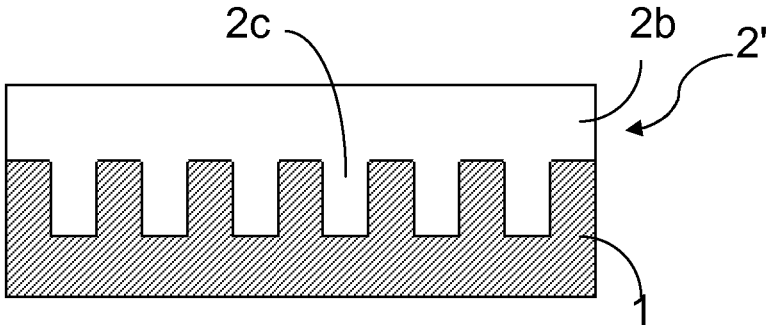
FIG. 1*b* schematically shows a copper layer 2' deposited onto the dielectric substrate 1 by electrodeposition.
Figure 1C:
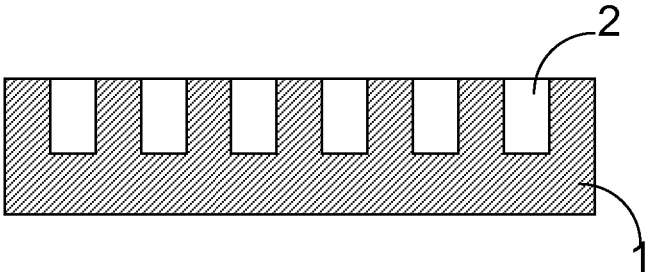
FIG. 1*c* schematically shows the removed overburden of copper 2b by chemical mechanical planarization (CMP).
Figure 2A:
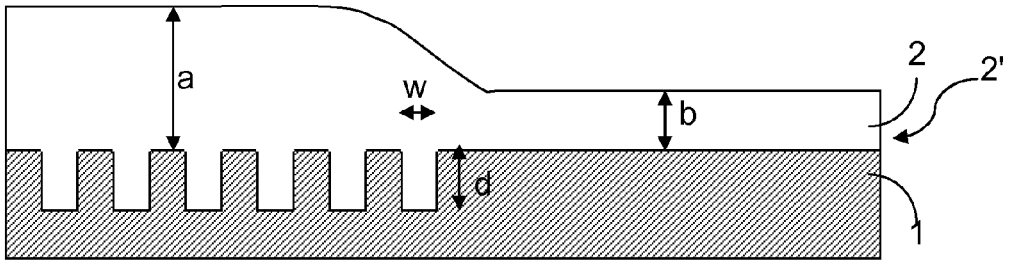
FIG. 2*a* schematically shows the result of an electrodeposition without using a leveling agent.
Figure 2B:
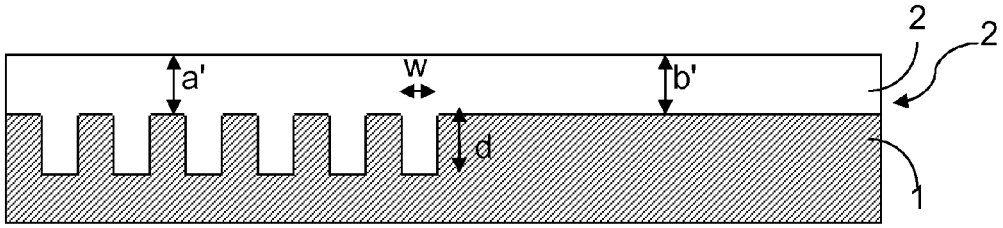
FIG. 2*b* schematically shows the result of an electrodeposition by using a leveling agent.

The following examples shall further illustrate the present invention without restricting the scope of this invention.

EXAMPLES

The amine number was determined according to DIN 53176 by titration of a solution of the polymer in acetic acid with perchloric acid.

The acid number was determined according to DIN 53402 by titration of a solution of the polymer in water with aqueous sodium hydroxide solution.

The molecular weight (Mw) was determined by size exclusion chromatography using hexafluoroisopropanol containing 0.05% potassium trifluoroacetate as eluent, hexafluoroisopropanol-packed (HFIP) gel columns as stationary phase and polymethylmethacrylate (PMMA) standards for determination of the molecular weights.

Example 1

Polyaminoamide from Piperazine and Methylene Bisacrylamide (Molecular Ratio 19:18)

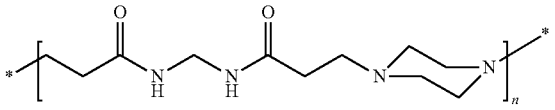

A 500 ml apparatus flushed with nitrogen was charged with methylene bisacrylamide (50.0 g, 324 mmol), water (150 g) and butylated hydroxyanisole (150 mg, 0.8 mmol). The resulting mixture was stirred vigorously (900 rpm). The reaction flask was protected from light by wrapping the apparatus with aluminum foil. The mixture was cooled to 0° C. and piperazine (29.5 g, 342 mmol) was added in portions during 30 min. After the complete addition of piperazine the resulting mixture was stirred additional 60 min at 0° C. Then, the cooling bath was removed and the reaction mixture was stirred at ambient temperature for 48 h at 500 rpm. The crude reaction mixture was concentrated under reduced pressure to give the title compound as light pink solid.

The resulting polyaminoamide showed an amine number of 2.95 mmol/g. Gel permeation chromatography revealed an average molecular weight of $M_w$=37400 g/mol and a polydispersity of $M_w/M_n$=1.7.

Comparative Example 2

A copper plating bath was prepared by combining 40 g/l copper as copper sulfate, 10 g/l sulfuric acid, 0.050 g/l chloride ion as HCl, 0.100 g/l of an EO/PO copolymer suppressor, and 0.028 g/l of SPS and DI water. The EO/PO copolymer suppressor had a molecular weight $M_w$ of below 5000 g/mol and terminal hydroxyl groups.

A copper layer was electroplated onto a structured silicon wafer purchased from SKW Associate Inc. containing grooves, so called trenches. These lines varied in width ranging from 130 nm to several micrometers with a depth of approximately 250 nm and a separation ranging from 130 nm to several micrometers. Such wafer substrates were brought into contact with the above described plating bath at 25 degrees C. and a direct current of −5 mA/cm$^2$ for 120 s followed by −10 mA/cm$^2$ for 60 s was applied.

The thus electroplated copper layer was investigated by profilometry inspection with a Dektak 3, Veeco Instruments Inc. The 130 nm and 250 nm feature sizes a field of nested wires was scanned and the height difference between the unstructured and structured area was measured.

Figure 3A:
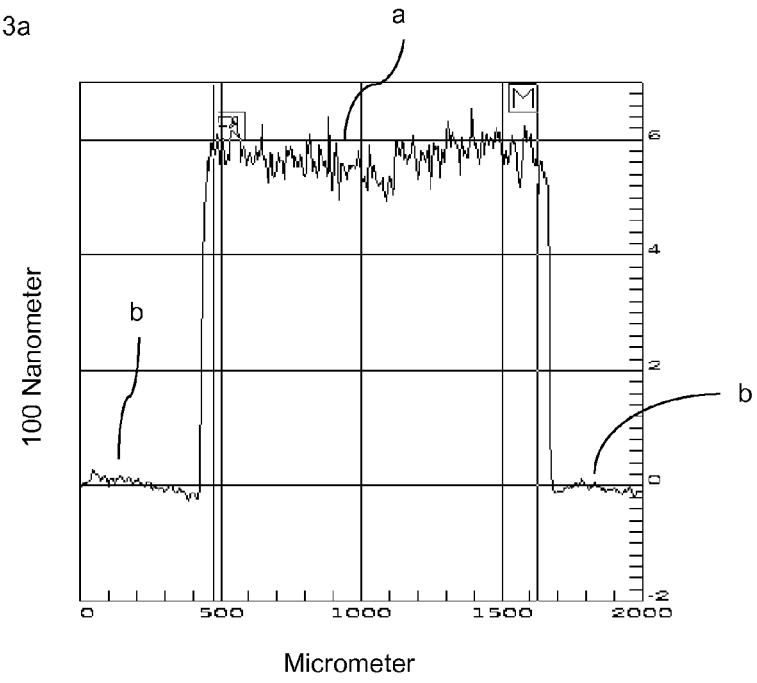
FIG. 3*a* shows a profilometry cross-sectional scan of nested trenches having 0.130 micrometer width with a separation of 0.130 micrometer without a leveler according to comparative example 2.
Figure 3B:
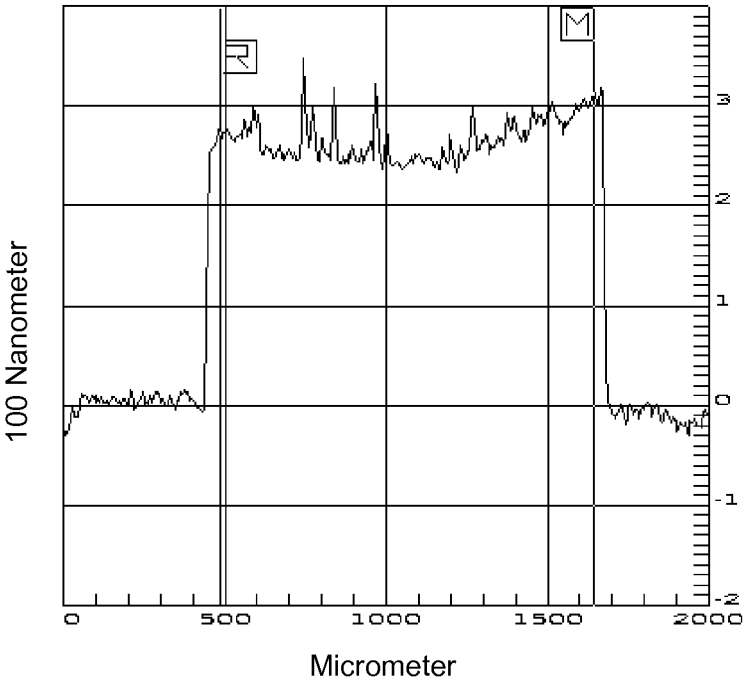
FIG. 3*b* shows a profilometry cross-sectional scan of 0.250 micrometer features without a leveler according to comparative example 2.

The results without using a leveling agent are shown in FIGS. 3*a* and 3*b* and show a profilometry cross-sectional scan of nested trenches having 0.130 micrometer width with a separation of 0.130 micrometer (FIG. 3*a*) and a cross-sectional scan of 0.250 micrometer features (FIG. 3*b*), respectively. Both, FIGS. 3*a* and 3*b* show a higher copper deposition rate on the structured area (a) in relation to the unstructured area (b). This phenomenon is well known as mounding and is strongly pronounced over the 0.130 and 0.250 micrometer trenches. The measured values are depicted in table 1.

Example 3

The procedure of comparative example 2 was repeated except that 1 ml/l of a 1% by weight aqueous solution of the polymer from example 1 was added to the plating bath.

A copper layer was electroplated onto a wafer substrate as described in comparative example 2. The thus electroplated copper layer was investigated by profilometry as described in comparative example 2.

Figure 4A:
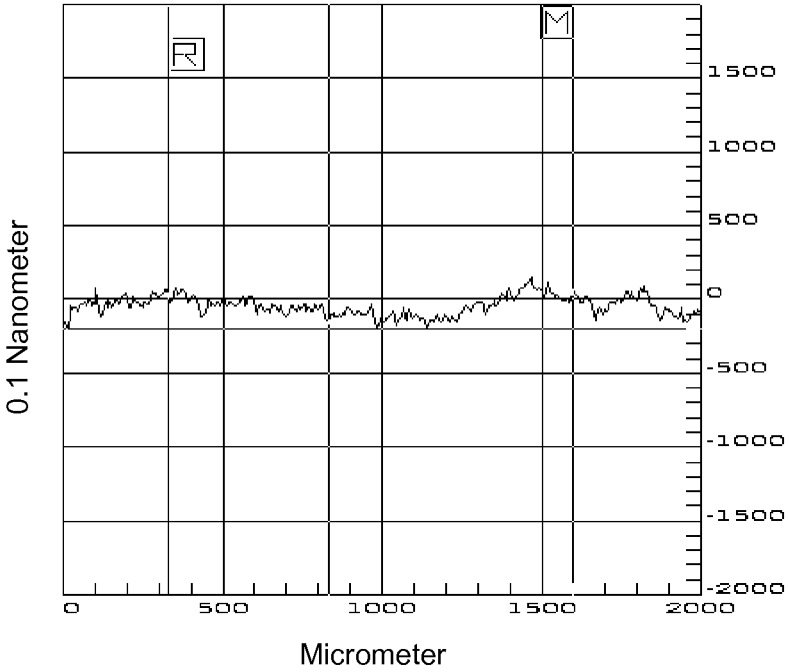
FIG. 4*a* shows a profilometry cross-sectional scan of nested trenches having 0.130 micrometer width with a separation of 0.130 micrometer with a leveler according to example 3.
Figure 4B:
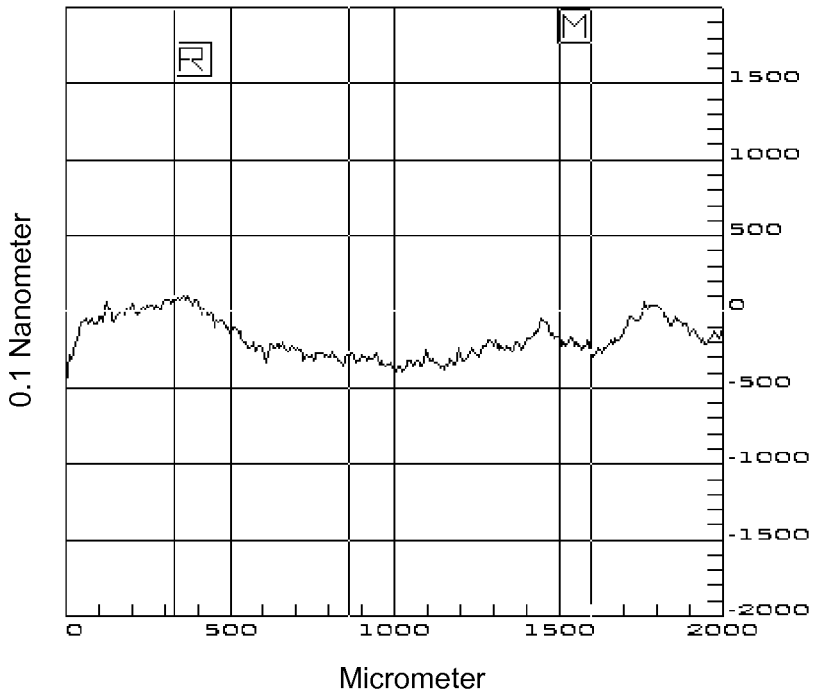
FIG. 4*b* shows a profilometry cross-sectional scan of 0.250 micrometer features with a leveler according to example 3.

The results using a plating bath with a leveling agent according to the present invention are shown in FIGS. 4*a* and 4*b* for different trench sizes. The profilometry cross-sectional scan of nested trenches having 0.130 micrometer width with a separation of 0.130 μm (FIG. 4*a*), respectively a cross-sectional scan of 0.250 μm features (FIG. 4*b*) show a significant reduction of the mounding compared to the prior art. The measured values are depicted in table 1.

TABLE 1

| | Feature size | |
|---|---|---|
| | 0.130 micrometer | 0.250 micrometer |
| example 2 (prior art) | +570 nm | +265 nm |
| example 3 | −5 nm | −22 nm |

The invention claimed is:

1. A composition, comprising:

a source of metal ions, at least one additive comprising at least one polyaminoamide comprising a structural unit represented by the formula I:

(I)

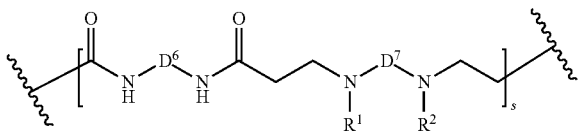

or a derivative of the polyaminoamide of the formula I obtained by complete or partial protonation, N-functionalization or N-quaternization with a non-aromatic reactant, wherein $D^6$ is selected from a straight chain or branched, acyclic or cyclic $C_1$-$C_{20}$ alkanediyl, wherein $D^6$ is the same or different when s is more than 1, $D^7$ is a divalent group selected from straight chain or branched $C_2$-$C_{20}$ alkanediyl, which may optionally be interrupted by heteroatoms or divalent groups selected from O, S and $NR^{10}$, wherein $D^7$ is the same or different when s is more than 1, $R^1$ is selected from H, $C_1$-$C_{20}$ alkyl, and $C_1$-$C_{20}$ alkenyl, which may optionally be substituted by hydroxyl, alkoxy or alkoxycarbonyl, or, together with $R^2$, may form a divalent group $D^8$, wherein $R^1$ is the same or different when s is more than 1, $R^2$ is selected from H, $C_1$-$C_{20}$ alkyl, and $C_1$-$C_{20}$ alkenyl, which may optionally be substituted by hydroxyl, alkoxy or alkoxycarbonyl, or, together with $R^1$ , may form a divalent group $D^8$, wherein $R^2$ is the same or different when s is more than 1, $D^8$ is selected from straight chain or branched $C_1$-$C_{18}$ alkanediyl, which may optionally be interrupted by heteroatoms or divalent groups selected from O, S and $NR^{10}$, s is an integer from 1 to 250, and $R^{10}$ is selected from H, $C_1$-$C_{20}$ alkyl, and $C_1$-$C_{20}$ alkenyl, which may optionally be substituted by hydroxyl, alkoxy or alkoxycarbonyl, and an accelerating agent.

2. The composition according to claim 1, wherein the polyaminoamide is represented by the formula IV:

(IV)

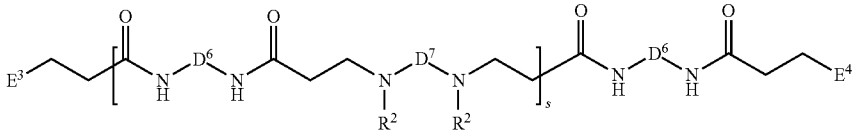

wherein $E^3$, $E^4$ are independently selected from the group consisting of:

(a) NH—$C_1$-$C_{20}$-alkyl or NH—$C_1$-$C_{20}$-alkenyl, (b) N—($C_1$-$C_{20}$-alkyl)$_2$ or N—($C_1$-$C_{20}$-alkenyl)$_2$ or N—($C_1$-$C_{20}$-alkyl)($C_1$-$C_{20}$-alkenyl)

(c) $NR^2$-$D^7$-$NR^2$H, and (d) $NR^2$-$D^7$-$NR^2$—$CH_2$—$CH_2$—CO—NH—($C_1$-$C_{20}$-alkyl) or $NR^2$-$D^7$-$NR^2$—$CH_2$—$CH_2$—CO—NH—($C_1$-$C_{20}$-alkenyl).

3. The composition according to claim 2, wherein $E^3$ and $E^4$ are independently defined as $NR^1$-$D^7$-$NR^2$H.

4. The composition according to claim 1, wherein the metal ions comprise copper ion.

5. The composition according to claim 1, wherein:

$D^6$ is $(CH_2)_g$, and g is an integer from 1 to 6.

6. The composition according to claim 1, wherein $D^7$ is a straight chain $C_2$- to $C_6$-alkanediyl.

7. The composition according to claim 1, wherein s is an integer from 1 to 150.

8. The composition according to claim 1, wherein $R^1$ is selected from the group consisting of H, $C_1$-$C_{20}$-alkyl, and $C_1$-$C_{20}$-alkenyl, which may optionally be substituted by hydroxyl, alkoxy or alkoxycarbonyl.

9. The composition according to claim 1, wherein $R^2$ is selected from the group consisting of H, $C_1$-$C_{20}$-alkyl, and $C_1$-$C_{20}$-alkenyl, which may optionally be substituted by hydroxyl, alkoxy or alkoxycarbonyl.

10. The composition according to claim 1, wherein $R^1$ and $R^2$ together form a divalent group $D^8$, with $D^8$ being a straight chain or branched $C_1$-$C_{18}$ alkanediyl, which may optionally be interrupted by at least one heteroatom or divalent group selected from the group consisting of O, S and $NR^{10}$, with $R^{10}$ being selected from H, $C_1$-$C_{20}$ alkyl, and $C_1$-$C_{20}$ alkenyl, which may optionally be substituted by hydroxyl, alkoxy or alkoxycarbonyl.

11. The composition according to claim 1, further comprising a suppressing agent.

12. The composition according to claim 1, wherein s is an integer from 2 to 100.

13. The composition according to claim 1, wherein s is an integer from 2 to 50.

14. A process for depositing a metal layer on a substrate, the process comprising:

a) contacting a metal plating bath comprising the composition according to claim 1 with a substrate; and b) applying a current density to the substrate for a time sufficient to deposit a metal layer onto the substrate.

15. The process according to claim 14, wherein the substrate comprises micrometer or nanometer sized features and the deposition is performed to fill the micrometer or nanometer sized features.

16. The process according to claim 15, wherein the nanometer-sized features have a size from 1 to 1000 nm, an aspect ratio of 4 or more, or both.

* * * * *